United States Patent [19]

Campbell, III

[11] Patent Number: 4,694,684

[45] Date of Patent: Sep. 22, 1987

[54] DYNAMIC BALANCING FOR SKIS

[76] Inventor: Harry J. Campbell, III, 667 Mill St., Excelsior, Minn. 55331

[21] Appl. No.: 829,415

[22] Filed: Feb. 13, 1986

[51] Int. Cl.[4] ..... G01M 1/12; A63C 11/26

[52] U.S. Cl. ..... 73/65; 73/66; 280/809; 272/146

[58] Field of Search ..... 73/65, 66, 480, 482, 73/487, 172, 862.04; 272/97, 146; 280/809, 607, 816; 269/906; 434/253

[56] References Cited

U.S. PATENT DOCUMENTS 2,573,808 11/1951 Ravoire ..... 272/97
3,525,522 8/1970 Piller ..... 272/146
3,929,329 12/1975 Rivera ..... 272/97
4,270,749 6/1981 Hebern ..... 272/146

FOREIGN PATENT DOCUMENTS 3232384 3/1984 Fed. Rep. of Germany ..... 280/809

*Primary Examiner*—John Chapman
*Attorney, Agent, or Firm*—Faegre & Benson

[57] ABSTRACT

A fixture and method for dynamically facilitating the optimum placement of a skier on the surface of skis. The fixture includes a pivotally mounted balance plate upon which the skis are positioned and the skier moves the boots to a dynamically neutral balance location so that when the skier flexes the upward and downward deflections of the ski tips can be controlled with equal ease.

8 Claims, 6 Drawing Figures

DYNAMIC BALANCING FOR SKIS

BACKGROUND OF THE INVENTION

The invention relates to a fixture for dynamically facilitating the optimum positioning of a skier on the surface of skis. The skier, while wearing ski boots, stands on the skis which are supported on a plate movable about a pivot axis positioned beneath the midpoint of the ski's running surface. The skier, while standing on the plate, flexes to deflect the ski tips upwardly and downwardly while the position of the skier on the surface of the ski is adjusted until a dynamically neutral balance point is determined where the upward and downward deflection of the ski tips can be controlled with equal ease.

1. Field of the Invention

The present invention relates to a fixture and a mthod for locating an optimum position for skiers on skis. In particular, the present invention relates to a fixture and method for locating an optimum dynamically neutral balance point for the positioning of the ski bindings on the ski which takes into effect the characteristics of both the ski boot and the physiology of the skier.

2. Description of the Prior Art

Currently, the positioning of ski boot bindings on alpine skis is determined by aligning a ski boot midsole mark indicative of the midpoint of the boot sole with a ski manufacturer's prescribed mounting mark on the surface of the ski. The mounting mark is typically a predetermined point which is generally determined by the manufacturer using statistical averages. Such a positioning system is ineffective for skiers whose physiology differs significantly from the statistical averages. More importantly, the prior art systems are not capable of dealing with individual variations in a person's flex, stance and balance. Such individual variations are significant. In particular, there is a substantial physiological difference in the flex, stance and balance characteristics of men and women which ought to be taken into account in the positioning of bindings on skis in order to enhance skier comfort, safety and efficiency for a particular skier.

Use of the present standards for aligning the boots and bindings on skis by utilizing the manufacturer's midsole mounting points typically positions many skiers, and particularly women, too far back on their skis. The deviation from a neutral dynamic balance point is often found to be several centimeters. Skiers positioned too far back or forward on their skis are not able to turn their skis as effectively and efficiently as skiers properly positioned at a dynamically neutral balance position on the skis who, therefore, have adequate control over the operation of the skis.

SUMMARY OF THE INVENTION

Therefore, it is an object of the present invention to provide a method of positioning a ski boot and binding on a ski at a dynamically neutral point comprising the steps of placing the defined balance point of the ski on a pivot plate positioned to allow the ski tip to be pivoted upwardly and downwardly about an axis perpendicular to the longitudinal axis of the ski; temporarily positioning the skier while wearing the ski boot with the midsole mark of the ski boot of the skier aligned with the manufacturer's prescribed mounting mark of the ski; pivoting the ski and boot combination about the pivot point by the skier while standing on the plate to determine, while the skier engages in flexing motion, whether upward or downward movement of the ski tip is accomplished easier; and adjusting the positioning of the ski boot relative to the balance point of the ski and repeating the positioning and pivoting steps until a dynamically neutral balance point is reached wherein downward and upward deflections of the tips of the skis may be accomplished by the skier with equal effort when flexing.

It is a further object of the present invention to provide a fixture for accomplishing the optimum dynamic balancing of a skier on a pair of skis using the skier's flex, stance and balance, the fixture including a frame and a platform pivotally mounted on the frame for pivotal deflection by a skier standing on the platform while wearing ski boots positioned on a ski having its balance point aligned with the pivot axis of the platform and with the platform constructed and arranged for allowing the tips of the skis to be deflected by flexing upwardly and downwardly by the skier with equal ease when the skier is positioned at a dynamically neutral balance point on the top of the ski.

DETAILED DESCRIPTION OF THE PREFERRED EMBODIMENTS

It is well known that the bottom of a ski is cambered so that the ski engages a surface at a front contact point and a back contact point. The balance point of the ski is usually defined as a point one-half the distance between the front and back contact points. It is also known that, in turning a ski, pressure exerted forward of the balance point will increase the ski's turning effect, while pressure exerted behind the balance point towards the tail will tend to straighten the run of the skis. Pressure exerted neutrally and directly through the balance point tend to stabilize the ski's turning effect.

In order to assure that the force vector for the skier's body weight can be moved, with equal effort, to either side of the balance point, rather than either predominantly forward or rearward of the balance point, the ski must be balanced to the physiological characteristics of the skier as well as ski boot characteristics.

Figure 1:
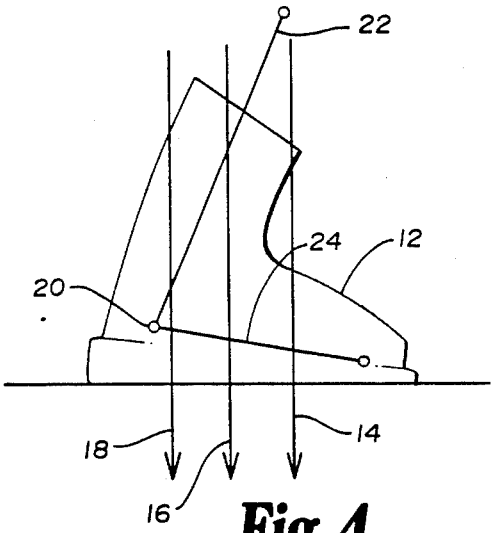
FIG. 1 is a balance point variation diagram showing, in exaggerated scale, three representative balance points for skiers having differing physiological characteristics.

FIG. 1 shows a ski boot 12 and several indications of the force and other vectors relating to the use of the boot in a skiing environment. Because of physiological and stance differences between individual skiers, the optimum balance points can vary markedly. The body weight vector designated 14 represents the balance point for a skier exhibiting what can be referred to as a forward flex, while the vector designated 16 is for a skier having neutral flex, and the vector designated 18 is for a skier exhibiting backward flex. Vectors 14, 16 and 18 represent the relative location of approximate pressure points for each of the types of skiers, but are not shown to scale. The balance points can vary by as much as several centimeters. If traditional boot positioning approaches were used, the vector for the skier with forward flex would probably be properly aligned with the ski's balance point. The skier exhibiting neutral flex would be mispositioned rearwardly of the balance point, and the skier exhibiting a backward flex would end up with this bindings mounted considerably rearwardly from the optimum position. In FIG. 1, the skier's flex point 20 is diagrammatically shown as is the stance component 22 and the pedal component 24. The variations in location of the flex point and the angles of the stance component 22 and pedal component 12 all result in the displacement of the skier's weight vectors 14, 16 and 18 relative to the midpoint of the boot.

Figure 2:
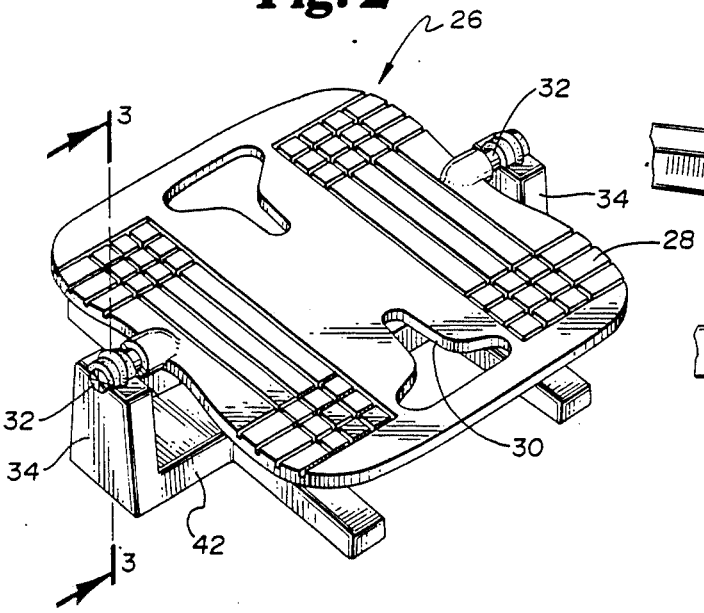
FIG. 2 is a perspective view of the present invention shown without skis mounted on the surface.
Figure 3:
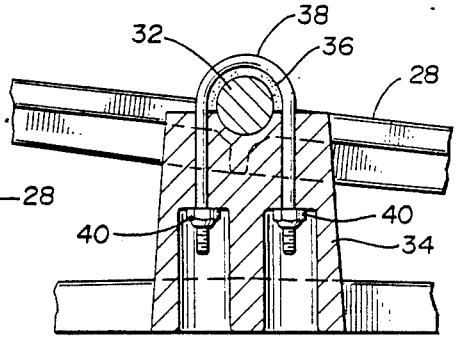
FIG. 3 is a sectional elevation view taken along line 3—3 of FIG. 2 and slightly enlarged therefrom.

FIG. 2 shows a device which can be used to properly and dynamically locate the position of the skier relative to the surface of the ski. The device generally designated 26 is comprised of a plate or platform 28 which may, if desired, have an opening 30 in the surface thereof. The plate may have a high friction surface thereon to prevent slippage of the ski. The high friction surface can be formed by a pattern of score lines. From each side of plate 28, a trunion 32 projects. Each trunion is supported by a pedestal 34. In the preferred embodiment shown, a friction pad 36 is mounted between the surface of trunion 32, and friction pad 36 and trunion 32 are secured to pedestal 34 by an inverted U-bolt 38 which is removably secured by nuts 40. Pedestal 34 is mounted on base or frame 42.

Figure 5:
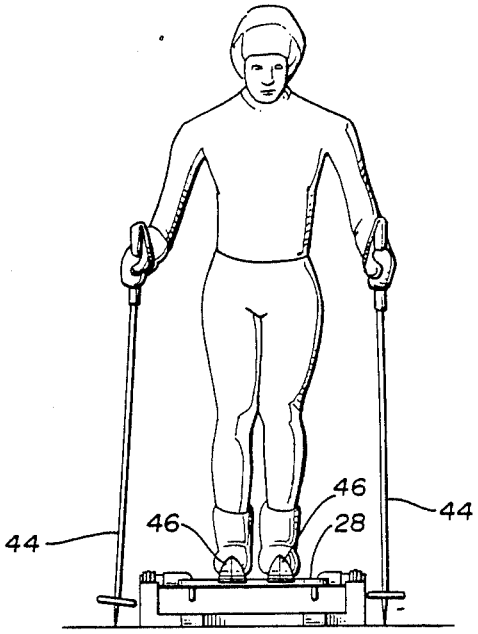
FIG. 5 is a front elevational view of a skier standing on the apparatus.
Figure 4:
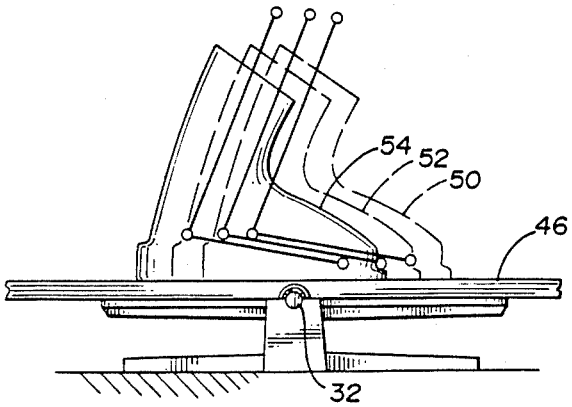
FIG. 4 is a balancing diagram showing, in exaggerated scale, variations of boot placement on the ski.

FIG. 5 shows a skier positioned on the frame for ski balancing. A skier's balance may be enhanced by having him grasp conventional ski poles 44 during the positioning. The skis 46 are positioned on plate 28 with the boot over the pivot point defined by trunions 32, as shown, for example, in FIG. 4. The balance point of the ski is positioned directly over pivot point of plate 28. The position of the skier's boot on the top of the ski is then adjusted forwardly or rearwardly in small increments until the ski tips can be raised and lowered with equal ease when flexing. In FIG. 4, the broken outline view of the boot designated 50 diagrammatically represents the balance point for a skier having backward flex, while the broken line outline 52 represents the position of a boot which is arrived at for a skier having neutral flex, and the outline of the boot designated 54 represents the final mounting position for a boot of a skier with forward flex.

Figure 6:
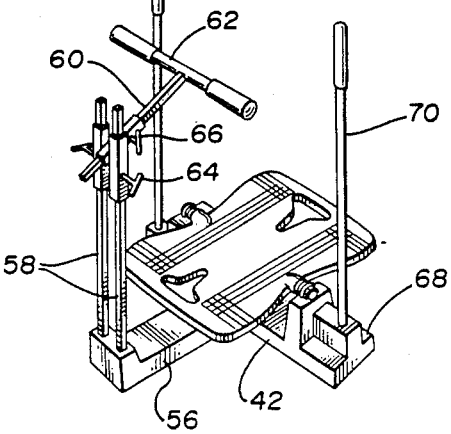
FIG. 6 is a perspective view of an alternate form of the invention.

FIG. 6 shows, in perspective form, an alternative form of the invention utilizing several additional features. Base 42 includes an additional projecting portion 56 which supports a pair of handle standards 58 upon which a support 60 for a T-handle 62 may be mounted. Suitable adjustment nuts 64 and 66 allow the handle 62 to be properly positioned for skiers of varying size. Provision of the built-in handle may be somewhat more convenient than having each of the skiers use ski poles while the ski position is determined.

FIG. 6 also shows additional projections 68 adjacent pedestal 34 for supporting vertical hip locaters 70 which assure the person fitting the skis that the skier's hips do no move significantly during the fitting process. If the position of the skier's hips is moved significantly forwardly or rearwardly of the pivot point, proper balancing of the skis is far more difficult.

Although the present invention has been described with reference to preferred embodiments, workers skilled in the art will recognize that changes may be made in form and detail without departing from the spirit and scope of the invention. For example, the operation of the balance plate 28 may be restrained by suitable counterbalance springs to minimize the tipping tendencies of the plate. Defection or strain gauges can also be used to provide a detectable output indication of the variance of the plate surface from a balanced condition. Balancing may also, without departure from my invention, by accomplished by testing the skier and boots only on the fixture to determine the displacement from the ski balance point for optimum balance.

What is claimed is:

1. A method of positioning a ski boot having a midsole mark thereon and a binding on a ski having a defined balance point and a prescribed binding mounting point at a dynamically neutral balance point comprising the steps of:

a. placing the defined balance point of the ski on a pivot plate positioned to allow the ski tip to be pivoted upwardly and downwardly about an axis positioned in the plane of the ski and perpendicular to the longitudinal axis of the ski;

b. temporarily positioning the skier, while wearing the ski boot, with the midsole mark of the ski boot of the skier aligned with the prescribed mounting point of the ski;

c. pivoting the ski and boot combination about the pivot axis by the skier while standing on the ski to determine whether upward or downward movement of the ski tip is accomplished easier when flexing; and d. adjusting the positioning of the ski boot relative to the balance point of the ski and repeating method steps (c) and (d) until a dynamically neutral balance point is reached wherein downward and upward deflections of the tips of the skis may be accomplished by the skier with equal effort when flexing.

2. A fixture for accomplishing the optimum dynamic balancing of a pair of skis while being stood upon by the skier, the fixture comprising, in combinations:

a. a frame; and b. platform having a pivot axis on a top surface thereof and mounted on the frame for deflection about the pivot axis by a skier standing on the platform with ski boots on a ski having the midpoint of the running surface thereof aligned with the pivot axis of the platform, the platform constructed and arranged for allowing the tips of the skis when the skier flexes to be deflected upwardly and downwardly by the skier with equal ease when the skier's boot is positioned at a dynamically neutral balance point on the surface of the ski.

3. The invention of claim 2 wherein the platform has a high friction upper surface for maintaining contact with the bottom surface of the ski.

4. The invention of claim 3 wherein the upper surface of the platform is scored to achieve a high friction surface.

5. The invention of claim 2 wherein the frame includes upright pedestal mounts positioned on both sides of the platform and wherein the platform has projecting trunnions constructed and arranged for engagement with the pedestal mounts to thereby support the platform for pivotal movement relative the frame.

6. A method for positioning a skier, a ski boot and a ski binding on a ski at a dynamically neutral balance point comprising the steps of;

a. determining a midpoint of the running surface of the ski and positioning the ski for pivotal movement about a pivotal axis oriented transverse to the longitudinal axis of the ski and adjacent to the midpoint of the running surface of the ski;

b. positioning the skier and boot at a beginning mounting position on the top of the ski in the vicinity of the midpoint of the running surface of the ski;

c. moving the ski tips upwardly and downwardly by having the skier flex upwardly and downwardly in a normal skiing action and determining whether upward or downward movement of the ski tip is accomplished with less effort;

d. adjusting the positioning of the skier, boot and binding relative to the beginning mounting position repetitively until a dynamically neutral balance point is reached wherein downward and upward deflections of the tips of the ski may be accomplished by the skier with equal effort when flexing; and e. mounting the bindings and boot to the skis at the location determined in step d.

7. The method claimed in claim 6 wherein the pivot axis is in the same plane as the running surface of the ski.

8. The invention in claim 6 wherein the midpoint of the running surface of the ski is determined from a manufacturer's suggested mounting position for the particular pair of skis.

* * * * *